US006642638B2

(12) United States Patent
Ishiguro

(10) Patent No.: US 6,642,638 B2
(45) Date of Patent: Nov. 4, 2003

(54) SPARK PLUG WITH IR-ALLOY CHIP

(75) Inventor: Hiroya Ishiguro, Kariya (JP)

(73) Assignee: Denso Corporation, Kariya (JP)

( * ) Notice: Subject to any disclaimer, the term of this patent is extended or adjusted under 35 U.S.C. 154(b) by 73 days.

(21) Appl. No.: 09/901,093

(22) Filed: Jul. 10, 2001

(65) Prior Publication Data

US 2002/0003389 A1 Jan. 10, 2002

(30) Foreign Application Priority Data

Jul. 10, 2000 (JP) ..... 2000-208824
May 30, 2001 (JP) ..... 2001-163155

(51) Int. Cl.[7] ..... H01T 13/20; H01T 13/22
(52) U.S. Cl. ..... 313/141; 313/143; 313/144; 123/169 EL
(58) Field of Search ..... 313/141–144; 445/7; 123/169 EL

(56) References Cited

U.S. PATENT DOCUMENTS 5,488,262 A * 1/1996 Takamura ..... 313/141
5,574,329 A * 11/1996 Kagawa ..... 313/141
5,877,584 A * 3/1999 Kato et al. ..... 313/143
5,982,080 A * 11/1999 Shibata et al. ..... 313/141
5,990,602 A * 11/1999 Katoh et al. ..... 313/141
6,304,022 B1 * 10/2001 Matsutani ..... 313/141
6,307,307 B1 * 10/2001 Kanao ..... 313/142
6,337,533 B1 * 1/2002 Hanashi et al. ..... 313/141
6,533,628 B1 * 3/2003 Matsutani ..... 445/7
2001/0022492 A1 * 9/2001 Matsutani ..... 313/143
2002/0130603 A1 * 9/2002 Teramura et al. ..... 313/141

FOREIGN PATENT DOCUMENTS

JP 8298178 11/1996
JP 2000-40577 8/2000

* cited by examiner

*Primary Examiner*—Nimeshkumar D. Patel
*Assistant Examiner*—German Colón
(74) *Attorney, Agent, or Firm*—Nixon & Vanderhye, PC

(57) ABSTRACT

An improved structure of a spark plug is provided for improving heat dissipation from an Ir-alloy chip attached to a ground electrode. The Ir-alloy chip works to a sequence of sparks between itself and the tip of a center electrode mounted in a metal shell and is embedded in a center electrode-facing surface of the ground electrode, thereby enhancing the transmission of heat produced in the Ir-alloy chip to the metal shell through the ground electrode.

14 Claims, 12 Drawing Sheets

SPARK PLUG WITH IR-ALLOY CHIP

BACKGROUND OF THE INVENTION

1. Technical Field of the Invention

The present invention relates generally to a spark plug which may be employed in automotive vehicles, gas pumps and cogeneration systems, and more particularly to a spark plug with a ground electrode having installed therein an Ir-alloy chip.

2. Background Art

Japanese Patent First Publication No. 8-298178 discloses a spark plug equipped with an Ir-alloy chip. The spark plug includes a center electrode and a ground electrode. The center electrode is disposed within a metal shell through a porcelain insulator and has a tip exposed outside an end of the metal shell. The ground electrode is joined to the end of the metal shell and has a spark discharging surface formed on an end thereof which defines an air gap (also called a spark plug gap) between itself and the tip of the center electrode. The Ir-alloy chip is installed on the spark discharging surface of the ground electrode for producing a sequential of sparks between itself and the end of the center electrode.

When the spark plug is used in an internal combustion engine, the Ir-alloy chip is subjected to intense heat. The heat principally dissipates from the Ir-alloy chip to the ground electrode and to the metal shell and the atmosphere. The Ir-alloy chip is bonded to the surface of the ground electrode through a corrosion resisting non-noble metallic member. Specifically, the whole of the Ir-alloy chip lies over the surface of the ground electrode. This structure, therefore, arrests the transmission of heat from the Ir-alloy chip to the ground electrode, so that the Ir-alloy chip is exposed to intense heat for a long time, resulting in acceleration of oxidation and wear of the Ir-alloy chip.

SUMMARY OF THE INVENTION

It is therefore a principal object of the invention to avoid the disadvantages of the prior art.

It is another object of the invention to provide a spark plug with an Ir-alloy chip joined to a ground electrode which is designed to provide a desired amount of heat dissipation from the Ir-alloy chip.

According to one aspect of the invention, there is provided a spark plug which may be employed in automotive vehicles, gas pumps and cogeneration systems. The spark plug comprises: (a) metal shell; (b) a center electrode retained within the metal shell to be insulated from the metal shell; (c) a ground electrode joined to the metal plug, the ground electrode having a center electrode-facing surface opposed to a tip of the center electrode through a spark plug gap; and (d) an Ir-alloy chip working to produce a spark between itself and the tip of the center electrode, the Ir-alloy chip being embedded in the center electrode-facing surface of the ground electrode with a portion thereof exposed outside the center electrode-facing surface of the ground electrode.

In the preferred mode of the invention, the Ir-alloy chip other than the exposed portion thereof is installed inside the ground electrode.

The Ir-alloy chip may alternatively have at least one surface which lies flush with a side surface of the ground electrode continuing from a peripheral edge of the center electrode-facing surface.

The exposed portion of the Ir-alloy chip projects from the center electrode-facing surface of the ground electrode toward the center electrode.

The Ir-alloy chip is joined to the ground electrode through at least one fused portion in which materials of the Ir-alloy chip and the ground electrode are melted together. The fused portion may be formed by laser welding.

The shortest distance between the fused portion and the center electrode is more than or equal to the sum of an interval between the tip of the center electrode and the Ir-alloy chip through the spark plug gap and 0.3 mm.

The ground electrode has a recess formed in the center electrode-facing surface. The Ir-alloy chip is fitted within the recess. The fused portion extends continuously from an outer side wall of the ground electrode inside the Ir-alloy chip through an outer side wall of the Ir-alloy chip.

The ground electrode has a second surface opposed to the center electrode-facing surface. The tip of the fused portion lies within the Ir-alloy chip closer to the center electrode-facing surface than the second surface. The distance between the tip of the fused portion and the bottom of the Ir-alloy chip lying inside the ground electrode is greater than or equal to 0.1 mm.

The length of a part of the fused portion lying within the Ir-alloy chip is greater than or equal to 0.2 mm.

The distance between the tip of the fused portion and the center electrode-facing surface of the ground electrode is greater than or equal to 0.2 mm.

The distance between the outer side wall of the Ir-alloy chip and the outer side wall of the ground electrode is greater than or equal to 0.25 mm.

The fused portion may lie close to a joint of the ground electrode and the metal shell from a center line of the Ir-alloy chip extending toward the center electrode through the spark plug gap.

The distance between an end of the exposed portion of the Ir-alloy chip oriented toward the center electrode and the center electrode-facing surface of the ground electrode lies within a range of 0.1 mm to 1.0 mm.

The Ir-alloy chip is made from material containing a main component of Ir (Iridium) and an additive of at least one of Rh (rhodium), Pt (platinum), Ru (ruthenium), Pd (palladium), and W (tungsten). The Ir-alloy chip may contain 70 to 99 Wt % of Ir.

The Ir-alloy chip may be joined to the ground electrode through a plurality of fused portions in which materials of the Ir-alloy chip and the ground electrode are melted together. In this case, at least one of the fused portion lies preferably close to a joint of the ground electrode and the metal shell from a center line of the Ir-alloy chip extending toward the center electrode through the spark plug gap for increasing the degree of joining of the Ir-alloy chip to the ground electrode.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a sectional view taken along the line A—A in FIG. 2(*a*);

FIG. 2(*c*) is an illustration which shows an Ir-alloy chip as viewed from a center electrode;

FIG. 7(*b*) is a sectional view taken along the line B—B in FIG. 7(*a*);

FIG. 8(*b*) is a partial illustration as viewed from a direction C in FIG. 8(*a*);

FIG. 9(*b*) is a partially sectional view taken along the line D—D in FIG. 9(*a*);

FIG. 13(*b*) is a sectional view taken along the line E—E in FIG. 13(*a*);

FIG. 18(*b*) is a sectional view taken along the line F-Fin FIG. 18(*a*);

FIG. 18(*c*) is a sectional view taken along the line H—H in FIG. 18(*a*)

DESCRIPTION OF THE PREFERRED EMBODIMENTS

Figure 1:
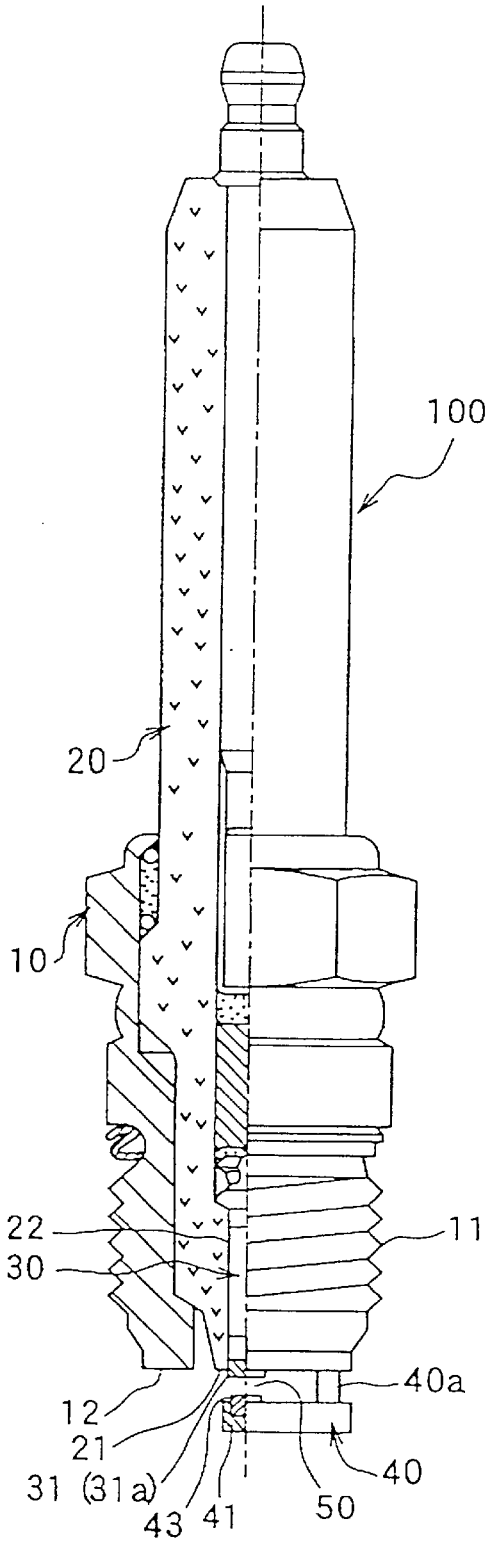
FIG. 1 is a partially sectional view which shows a spark plug with an Ir-alloy chip according to the first embodiment of the invention.

Referring to the drawings, wherein like reference numbers refer to like parts in several views, particularly to FIG. 1, there is shown a spark plug 100 which may be used in a gas engine of a generator in a cogeneration system.

The spark plug 100 includes a cylindrical metal shell 10, a porcelain insulator 20, a center electrode 30, and a ground electrode 40. The metal shell 10 has cut therein a thread 11 for mounting the spark plug 100 in an engine block (not shown). The porcelain insulator 20 made of an alumina ceramic ($Al_2O_3$) is retained within the metal shell 10 and has a tip 21 exposed outside an end 12 of the metal shell 10.

Figure 2A:
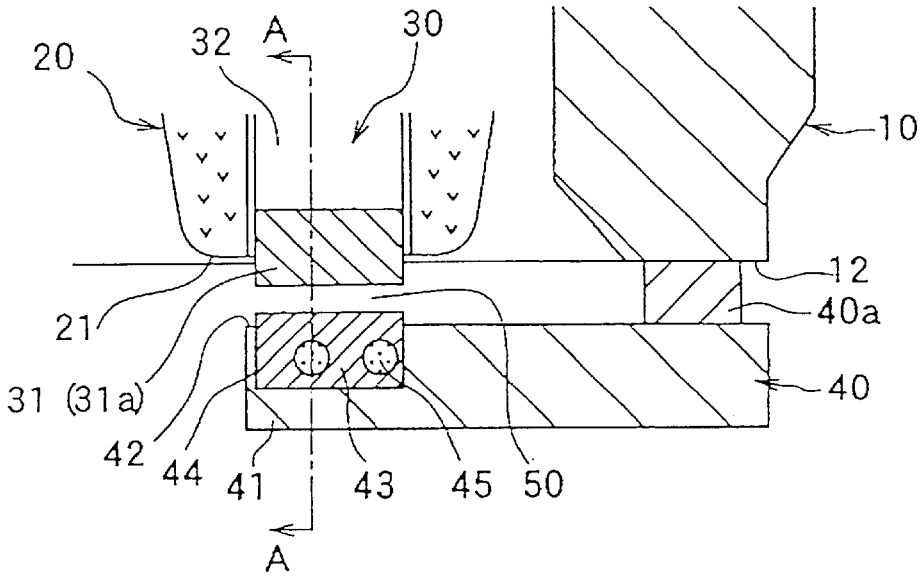
FIG. 2(*a*) is a partially enlarged sectional view which shows a joint structure for an Ir-alloy chip in the first embodiment of the invention.
Figure 2B:
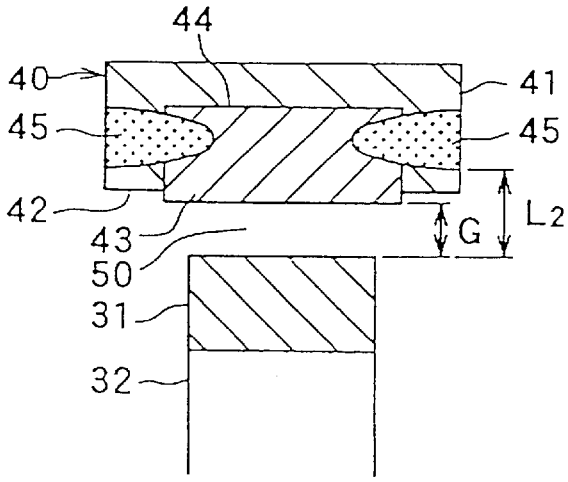
Figure 2C:
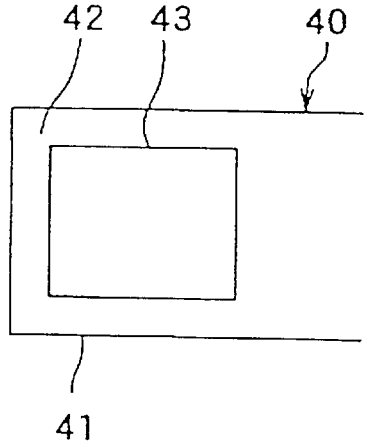

The center electrode 30 is secured in a central chamber 22 of the porcelain insulator 20 and insulated electrically from the metal shell 10. The center electrode 30 has a tip 31 projecting from the tip 21 of the porcelain insulator 20 outside the end 12 of the metal shell 10. The center electrode 30, as shown in FIG. 2(*a*), consists of a body 32 and an Ir-alloy chip 31*a*. The body 32 is made of a cylindrical member which consists of a core portion made of a metallic material such as Cu having a higher thermal conductivity and an external portion made of a metallic material such as an Ni-based alloy having higher thermal and corrosion resistances. The Ir-alloy chip 31*a* is welded to an end of the body 32 to define the tip 31.

The ground electrode 40 made of an Ni-alloy bar or an Fe-alloy bar is welded to the end 12 of the metal shell 10 through an intermediate block 40*a*. The intermediate block 40*a*, is made of an Ni-alloy or an Fe-alloy. The ground electrode 40, as clearly shown in FIG. 2(*a*), has an end 41 which faces at a side surface 42 thereof the tip 31 of the center electrode 30 through a spark plug gap 50. The side surface 42 forms a spark discharging surface. A second Ir-alloy chip 43 is embedded in the spark discharging surface 42 which works to produce a sequence of sparks between itself and the tip 31 of the center electrode 30.

The second Ir-alloy chip 43, as can be seen from FIG. 2(*a*), projects partially from the spark discharging surface 42 of the ground electrode 40. A peripheral wall of the Ir-alloy chip 43 may either coincide partially with or be all located inside an edge of the spark discharging surface 42. In this embodiment, the whole of the Ir-alloy chip 43 is, as shown in FIG. 2(*c*), located inside the periphery of the spark discharging surface 42.

The attachment of the Ir-alloy chip 43 to the ground electrode 40 is accomplished in the following manner. First, the Ir-alloy chip 43 is put on the spark discharging surface 42 and forced thereinto to form a recess 44 which has substantially the same area as that of the Ir-alloy chip 43. The laser beams are, as shown in FIG. 2(*b*), applied to each outer side wall of the recess 44 to form fused portions 45 where materials of the ground electrode 40 and the Ir-alloy chip 43 are melted together, thereby producing joints of the Ir-alloy chip 43 and the ground electrode 40. The recess 44 may alternatively be formed using cutting or cold forging techniques.

The Ir-alloy chip 43, as can be seen from FIG. 2(*a*), projects partially from the spark discharging surface 42 toward the tip 31 of the center electrode 30 to define the spark plug gap 50, as described above.

Each of the Ir-alloy chips 31*a* and 43 is made from material containing a main component of Ir (Iridium) and an additive of at least one of Rh (rhodium), Pt (platinum), Ru (ruthenium), Pd (palladium), and W (tungsten). In this embodiment, the Ir-alloy chips 31*a* and 43 each contain 90 Wt % of Ir and 10 Wt % of Rh (referred to as an Ir-10 Rh below).

The Ir-alloy chip 43 is, as discussed above, located inside the outer periphery of the spark discharging surface 42. Specifically, most of the Ir-alloy chip 43 is surrounded by the ground electrode 40 in contact therewith. Therefore, when a spark discharge is taken place between the Ir-alloy chips 43 and 31*a*, the heat produced in the Ir-alloy chip 43 flows to the metal shell 10 through the ground electrode 40 effectively, thus resulting in an increased degree of dissipation of heat from the Ir-alloy chip 43 as compared with the conventional spark plug as discussed in the introductory part of this application.

Figure 3:
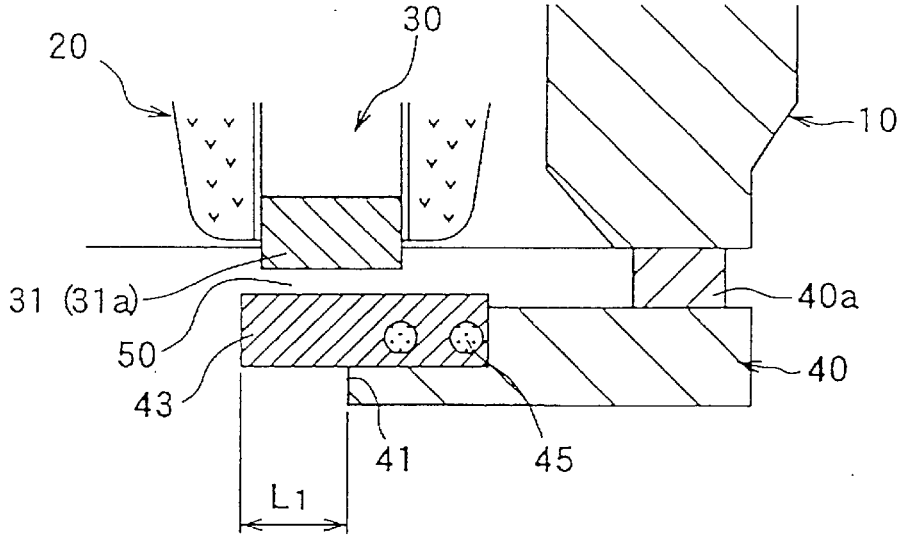
FIG. 3 is a partially enlarged sectional view which shows a joint structure of a spark plug sample used in durability tests.

We researched a suitable length $L_1$, as shown in FIG. 3, of a portion of the Ir-alloy chip 43 projecting from the end 41 of the ground electrode 40 in terms of the degrees of dissipation of heat from the Ir-alloy chip 43 and spark-caused wear of the Ir-alloy chip 43. We first performed durability tests of the spark plug 100 for different lengths $L_1$ of 4 mm to −2 mm. The spark plug 100 was installed in a 6-cylinder gas cogeneration engine and run for 500 hours under a condition of a rated engine output. A thermocouple thermometer was used to measure the temperature of the Ir-alloy chip 43. After the durability tests, a worn volume of the Ir-alloy chip 43 was measured.

Figure 4:
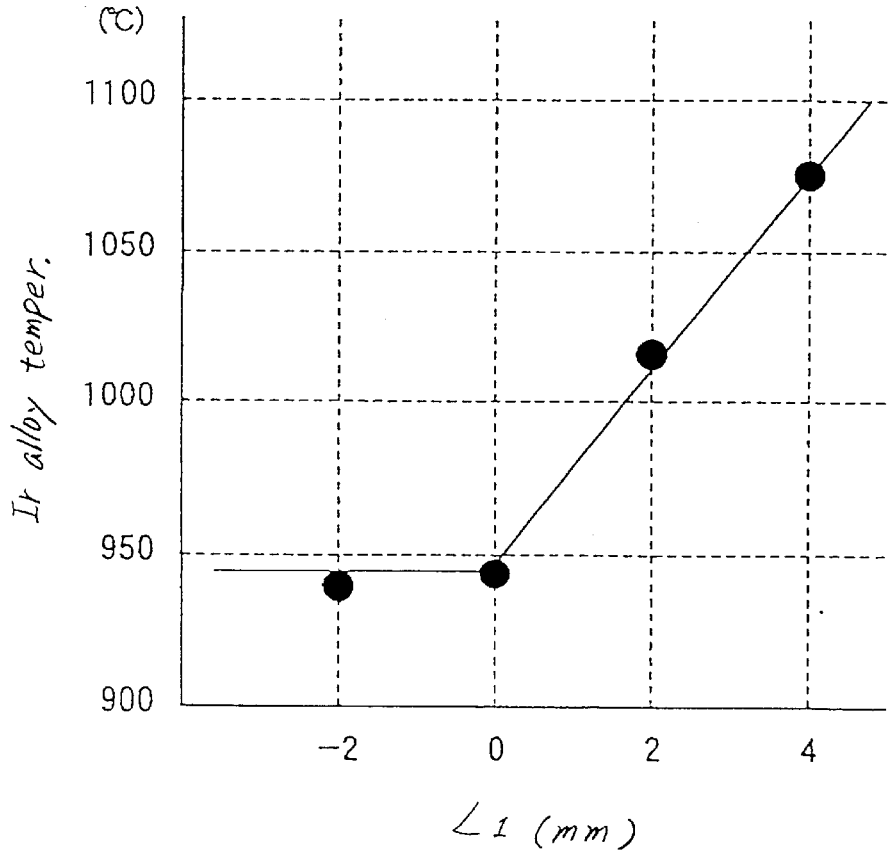
FIG. 4 is a graph which indicates a relation between the length $L_1$ (mm) of a projecting portion of an Ir-alloy chip and the temperature (° C.) of the Ir-alloy chip.
Figure 5:
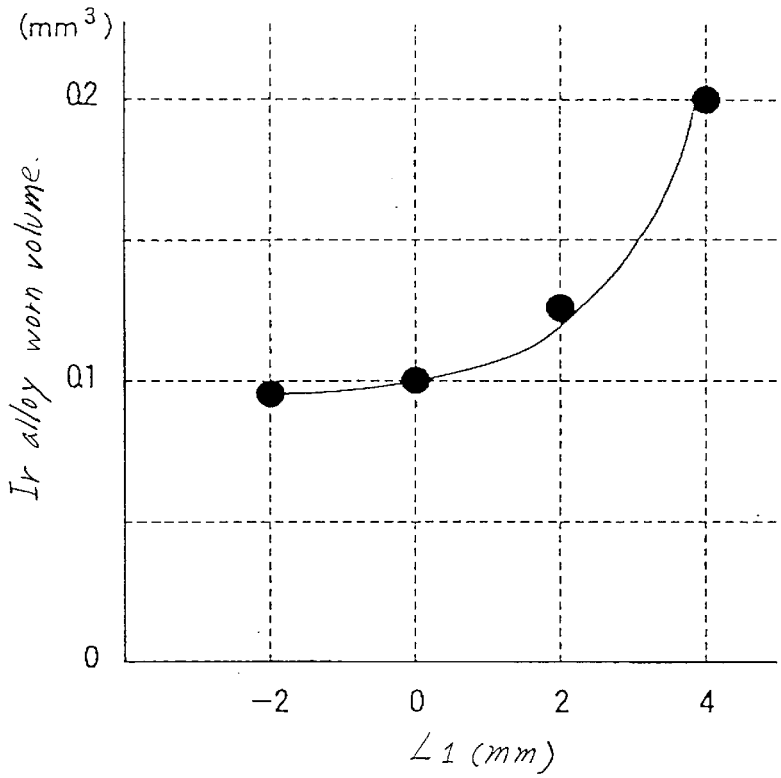
FIG. 5 is a graph which indicates a relation between the length $L_1$ (mm) and the worn volume ($mm^3$) of an Ir-alloy chip.

FIG. 4 indicates a relation between the length $L_1$ (mm) of the projecting portion of the Ir-alloy chip 43 and the temperature (° C.) of the Ir-alloy chip 43. FIG. 5 indicates a relation between the length $L_1$ (mm) and the worn volume ($mm^3$) of the Ir-alloy chip 43. The graph of FIG. 4 shows that the temperature of the Ir-alloy chip 43 is lowered most when the length $L_1$ is less than 0 mm. Similarly, the graph of FIG. 5 shows that the worn volume of the Ir-alloy chip 43 is minimized when the length $L_1$ is less than 0 mm. This is because when the length $L_1$ is decreased below 0 mm, the oxidation-caused wear of the Ir-alloy chip 43 is suppressed to increase the spark wear resistance thereof. Note that length $L_1$ m=0 mm indicates the case where the end of the Ir-alloy chip 43 lies flush with the outer periphery of the spark discharging surface 42.

As apparent from the above discussion, most of the Ir-alloy chip 43 is embedded in the spark discharging surface 42, thus resulting in an increased degree of heat dissipation from the Ir-alloy chip 43. The Ir-alloy chip 43 has one surface exposed outside the spark discharging surface 42 toward the tip 31 of the center electrode 30, thereby enabling the spark plug gap 50 to be defined allowing for the amount of spark-caused wear of the Ir-alloy chip 43, which results in an increase in service left of the spark plug 100. A sequence of sparks are produced mainly between the tip 31 of the center electrode 30 and the Ir-alloy chip 43, thus minimizing the amount of wear of the spark discharging surface 42 of the ground the spark plug 100.

The Ir-alloy chip 43 is, as described above, laser-welded to the ground electrode 40 to form the fused portions 45. If the shortest distance, as shown in FIG. 2(*a*), between the tip 31 of the center electrode 30 and each of the fused portions 45 is defined as $L_2$, it is advisable that $L_2$ be longer than the sum of the distance G between the Ir-alloy chips 31 and 43 through the spark plug gap 50 and 0.3 mm. This value is found based on results of tests, as discussed below, performed by the inventors of this application in terms of the relation between the shortest distance $L_2$ and sparks landing on the fused portions 45.

Figure 6:
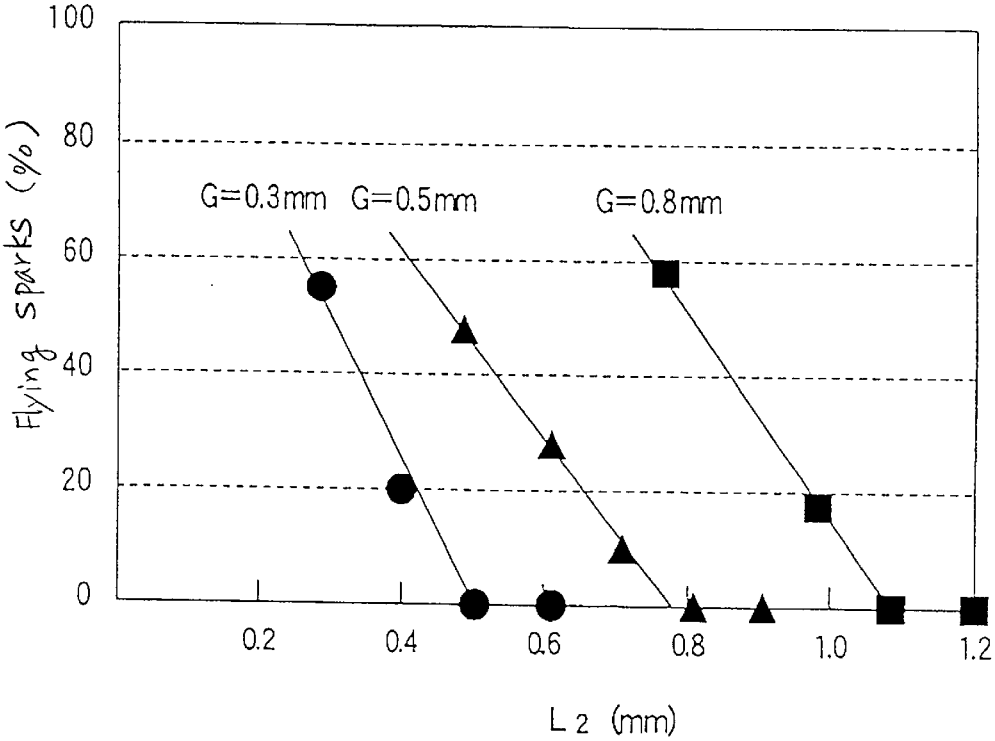
FIG. 6 is a graph which indicates the relation between the shortest length $L_2$ in FIG. 2(*b*) and the number of sparks flying at fused portions forming joints of an Ir-alloy chip and a ground electrode.

In the tests, spark plugs with the Ir-alloy chip 43 whose gap 50 (i.e., the distance G) lies within a range of 0.3 mm to 0.8 mm and which have different length $L_2$ were prepared. The spark plugs were installed in a test chamber under a gauge pressure of 0.6 Mpa. The voltage was applied to each of the spark plugs to produce a sequence of sparks to measure the number of sparks flying at the fused portions 45. FIG. 6 indicates the relation between the shortest length $L_2$ and the number of sparks flying at the fused portions 45 and shows that all the sparks fly within the spark plug gap 50 when the distance G is 0.3 mm, as indicated by black circles, and the shortest length $L_2$ is more than 0.5 mm or more, when the distance G is 0.5 mm, as indicated by black triangles, and the shortest length $L_2$ is 0.8 mm or more, and when the distance G is 0.8 mm, as indicated by black squares, and the shortest length $L_2$ is more than 1.15 mm or more. Specifically, when length $L_2 \geqq G+0.3$ mm, the possibility that sparks occur between the fused portions 45 and the tip 31 of the center electrode 30 will be zero (0), thus minimizing the spark-caused wear of the fused portions 45.

The Ir-alloy chip 43 is welded to the inner wall of the recess 44 in the ground electrode 40 by irradiating laser beams to the outer wall of the recess 44, so that the fused portions 45 which contain less Ir than the Ir-alloy chip 43 and are inferior in spark wear resistance are formed outside a spark discharging portion of the ground electrode 40, thereby minimizing the spark-caused wear of the fused portions 45.

Figure 7A:
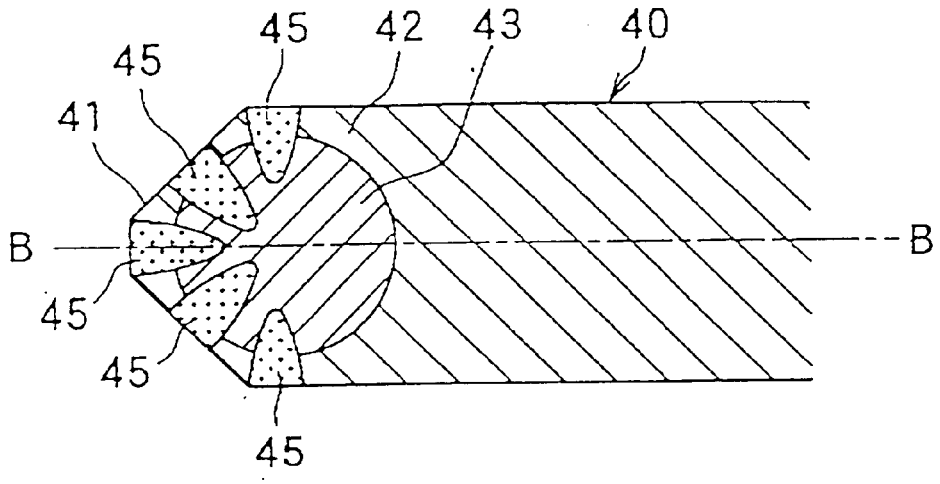
FIG. 7(*a*) is a sectional view which shows a modification of the first embodiment.
Figure 7B:
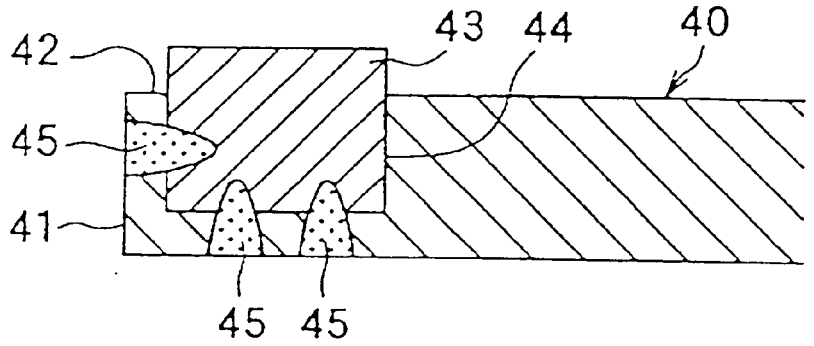

The surface of the Ir-alloy chip 43 exposed to the spark plug gap 50 is, as shown in FIG. 2(*c*), rectangular, however, may alternatively be, as shown in FIG. 7(*a*), circular. Specifically, the Ir-alloy chip 43 may be made of an Ir-alloy disc. FIG. 7(*b*) shows a vertical cross section taken along the line B—B in FIG. 7(*a*).

Figure 8A:
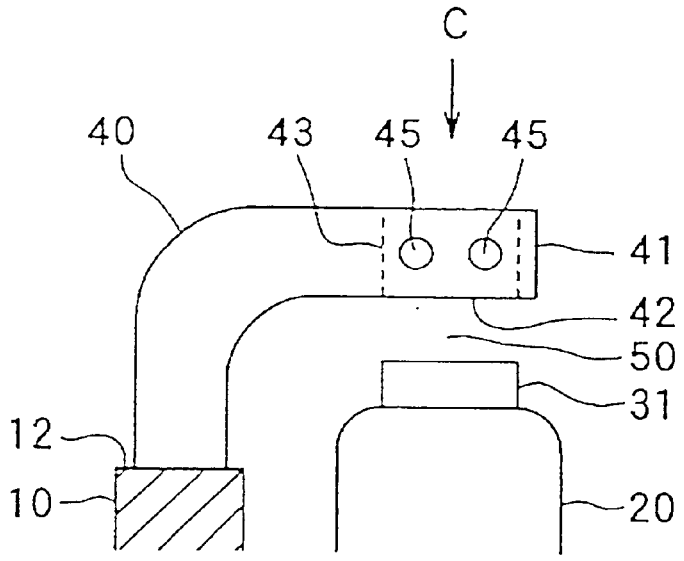
FIG. 8(*a*) is a partial view which shows another modification of the first embodiment.
Figure 8B:
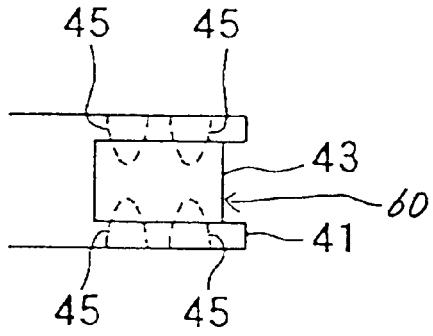

The Ir-alloy chip 43 may alternatively be embedded in the ground electrode 40 in the manner as illustrated in FIGS. 8(*a*) and 8(*b*). FIG. 8(*b*) shows the surface of the Ir-alloy chip 43 as viewed from a direction C in FIG. 8(*a*). Specifically, the ground electrode 40 has a C-shaped opening 60 formed in the end thereof by cutting or forging. The Ir-alloy chip 43 is fitted in and laser-welded to the C-shaped chamber 60 in the same manner as described above. The laser beams may alternatively be irradiated to an interface between an inner wall of the opening 60 and an outer wall of the Ir-alloy chip 43 to weld the Ir-alloy chip 43 to the ground electrode 40. The ground electrode 40 may be installed, as shown in FIG. 8(*a*), directly on the end of the metal shell 10.

Figure 9A:
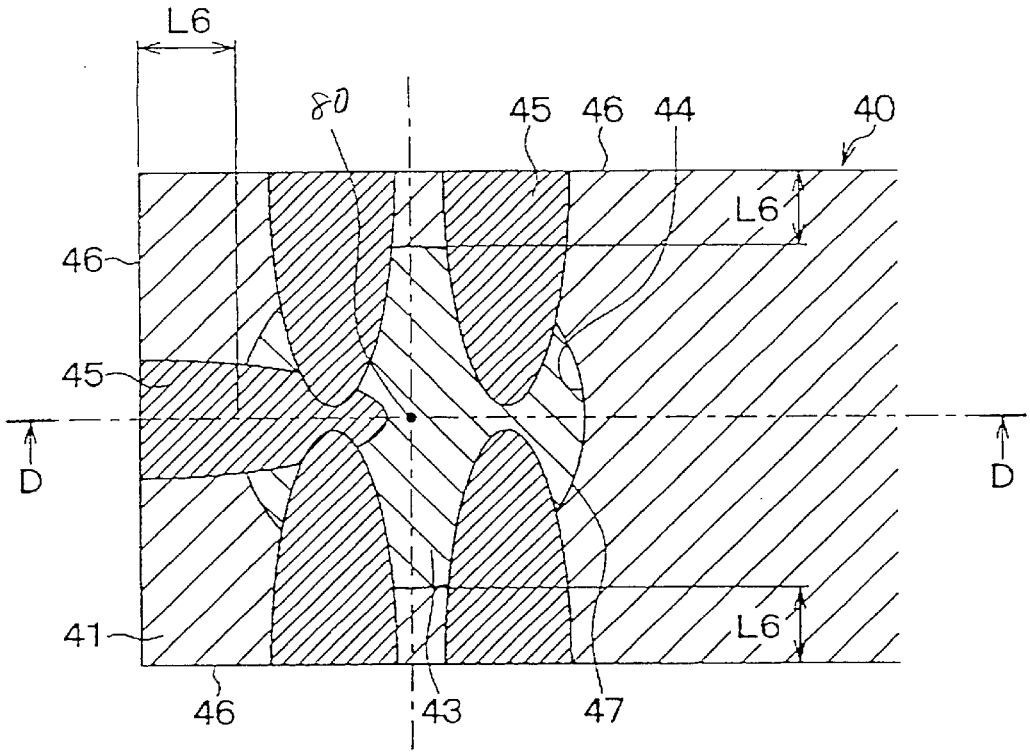
FIG. 9(*a*) is a partially sectional view which shows a spark plug according to the second embodiment of the invention.
Figure 9B:
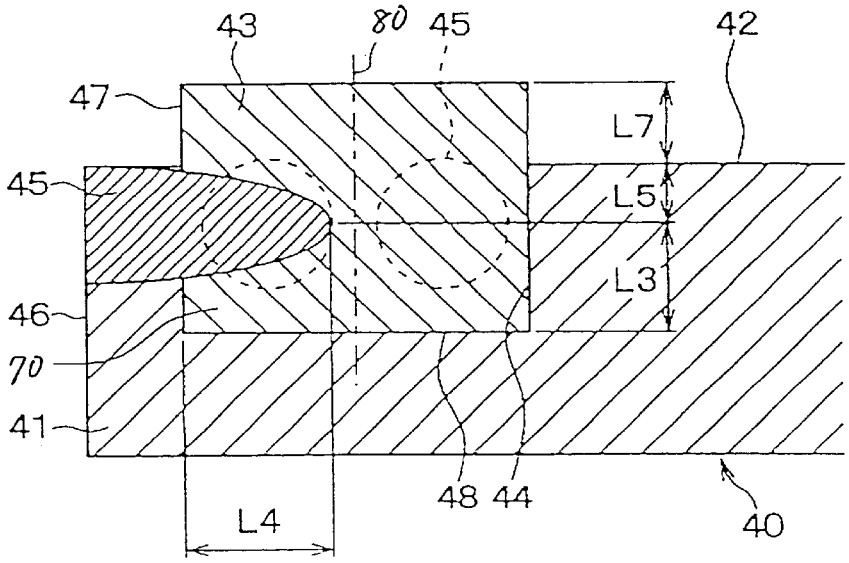

FIGS. 9(*a*) and 9(*b*) show the second embodiment of the invention.

Usually, the thermal stress arising from burning of the engine may cause cracks to be formed between the Ir-alloy chip 43 and the fused portions 45 which lead to dislodgement of the Ir-alloy chip 43 from the ground electrode 40. Particularly, when used in a gas cogeneration engine operated continuously under high loads, spark plugs are exposed at electrodes to intense heat, thus having a high possibility of formation of such cracks.

The second embodiment aims at forming the fused portions 45 under optimum conditions in order to avoid the dislodgement of the Ir-alloy 43 from the ground electrode 40. FIG. 9(*a*) illustrates the Ir-alloy chip 43 embedded in the ground electrode 40, as viewed from the side of the center electrode 30. FIG. 9(*b*) is a sectional view taken along the line D—D in FIG. 9(*a*).

The Ir-alloy chip 43 is made of a disc member. The Ir-alloy chip 43 is fitted in the recess 44 of the ground electrode 40 and laser-welded to form, as clearly shown in FIG. 9(*a*), five fused portions 45. The fused portions 45 each extend continuously from the outer side surface 46 of the ground electrode 40 to a central portion of the Ir-alloy chip 43 through an outer side wall 47 of the Ir-alloy chip 43. The Ir-alloy chip 43 is, like the first embodiment, exposed partially outside the surface of the ground electrode 40 toward the center electrode 30 through the spark plug gap 50. The ground electrode 40 is joined at the right side thereof, as viewed in the drawings, to the metal shell 10.

We made a study of optimum conditions for forming the fused portions 45, which will be discussed below in detail.

The tip of each of the fused portions 45 is, as can be seen from FIG. 9(*b*), located closer to the spark discharging surface 42 of the ground electrode 40 than the bottom 48 of the Ir-alloy chip 43. Durability tests were performed for different values of distance $L_3$ between the bottom 48 of the Ir-alloy chip 43 and the tip of each of the fused portions 45 using spark plug samples prepared in three sets of four. The three sets have $L_3$=0 mm, $L_3$=0.1 mm, $L_3$=0.2 mm, respectively. In each sample, the length $L_4$ of a tip of each of the fused portions 45 entering the Ir-alloy chip 43 was 0.5 mm.

The spark plug samples were exposed to air at 1000° C. for six minutes, after which they were left in air at 25° C. for six minutes. This thermal shock test were repeated cyclically (i.e., a thermal cycle test). The spark plug samples having $L_3$=0 mm all experienced dislodgement of the Ir-alloy chip 43 from the ground electrode 40 before 100 cycles of the thermal shock tests. The spark plug samples having $L_3$=0.1 mm and $L_3$=0.2 mm all did not experience dislodgement of the Ir-alloy chip 43 from the ground electrode 40 even after 800 cycles of the thermal shock tests. It is, therefore, found that the distance $L_3$ between the tip of the fused portions 45 and the bottom 48 of the Ir-alloy chip 43 is preferably greater than or equal to 0.1 mm (i.e., $L_3 \geqq 0.1$ mm) in order to avoid the dislodgement of the Ir-alloy chip 43 from the ground electrode 40.

Each of the fused portions 45, as can be seen from FIG. 9(*b*), extends perpendicular to a direction in which the Ir-alloy chip 43 peels off the ground electrode 40. Thus, when the distance $L_3$ is set more than 0.1 m, a relatively thick bottom wall 70 is defined beneath the fused portions 45, thereby keeping tight engagement of the Ir-alloy chip 43 with the inner wall of the recess 44 even if cracks occur between the Ir-alloy chip 43 and the fused portions 45.

Additionally, similar thermal shock tests were also performed for different values of length $L_4$ of the tip of each of the fused portions 45 entering the Ir-alloy chip 43 using spark plug samples prepared in three sets of four. The three sets have $L_4$=0.2 mm, $L_4$=0.5 mm, $L_4$=0.8 mm, respectively. In each sample, the distance $L_3$ between the tip of each of the fused portions 45 and the bottom 48 of the Ir-alloy chip 43 was 0.2. All the spark plug samples do not experience the dislodgement of the Ir-alloy chip 43 from the ground electrode 40 even after 800 cycles of the thermal shock tests. It is, thus, found that when the distance $L_3$ is more than or equal to 0.1, and the length $L_4$ is more than or equal to 0.2, it enhances the avoidance of dislodgement of the Ir-alloy chip 43 from the ground electrode 40.

We also made a study of suitable values of distance $L_5$ between the tip of each of the fused portions 45 and the spark discharging surface 42 of the ground electrode 40 and found that the distance $L_5$ of more than or equal to 0.2 is required for forming the fused portions 45 desirably.

The above thermal shock tests also showed that when the distance $L_6$ between the outer side wall 47 of the Ir-alloy chip 43 (i.e., a line tangent to the outer side wall 47 of the Ir-alloy chip 43) and the outer side wall 46 of the ground electrode 40 is less than 0.25 mm, it may cause cracks to be formed in the ground electrode 40 before dislodgement of the Ir-alloy chip 43. It is, thus, advisable that distance $L_6$ be more than or equal to 0.25 mm.

We further made a study of suitable values of length $L_7$ of a portion of the Ir-alloy chip 43 exposed outside the spark discharging surface 42 toward the center electrode 30 and found that when the length $L_7$ is set more than or equal to 0.1, it enables a sequence of sparks to be produced between the center electrode 30 and the Ir-alloy chip 43 and also serves to prevent sparks from flying directly at the ground electrode 40, and that when the length $L_7$ is more than 1.0 mm, the temperature of the Ir-alloy chip 43 is elevated undesirably by the heat of burning of the engine, which will result in an increase in wear of the Ir-alloy chip 43. Therefore, it is advisable that the length $L_7$ meet a relation of $0.1 \leqq L_7 \leqq 1.0$ mm.

In order to enhance the heat flow from the Ir-alloy chip 43, at least one of the fused portions 45 is preferably formed close to the joint of the ground electrode 40 and the metal shell 10 (i.e., the right side of the drawings) from a vertical center line 80 of the Ir-alloy chip 43. In this embodiment, two of the fused portions 45 are located on the right side of the vertical center line 80.

The shortest distances $L_6$ between the outer side wall 46 of the ground electrode 40 and the outer side wall 47 of the Ir-alloy chip 43 are preferably equal to each other because it makes it possible to form the fused portions 45 in the same welding condition, thereby facilitating ease of a welding operation or resulting in a decrease in manufacturing process.

Figure 10:
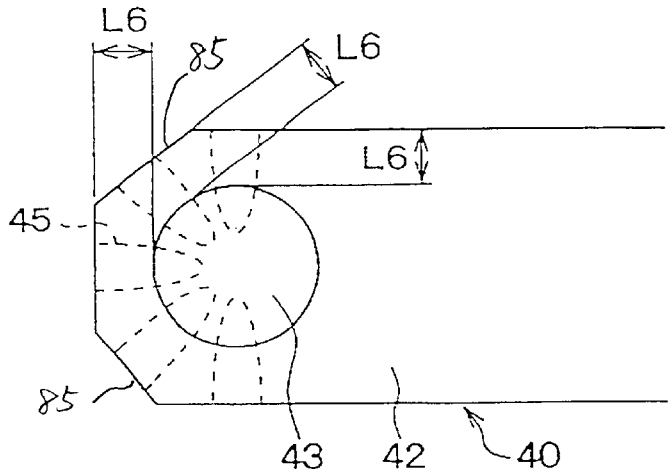
FIG. 10 is a partially plan view which shows an Ir-alloy chip and a ground electrode of a spark plug according to the third embodiment of the invention.

FIG. 10 shows the Ir-alloy chip 43 embedded in the ground electrode 40 according to the third embodiment of the invention, as viewed from the side of the center electrode 30.

Two corners of the tip of the ground electrode 40 are cut to form surfaces 85 tapering off to the tip. The fused portion 45 is formed in each of the tapered surfaces 85. It is advisable that the distances $L_6$ be equal to each other for facilitating ease of the welding operation to join the Ir-alloy chip 43 to the ground electrode 40. Other arrangements are identical with those in the first embodiment, and explanation thereof in detail will be omitted here.

Figure 11:
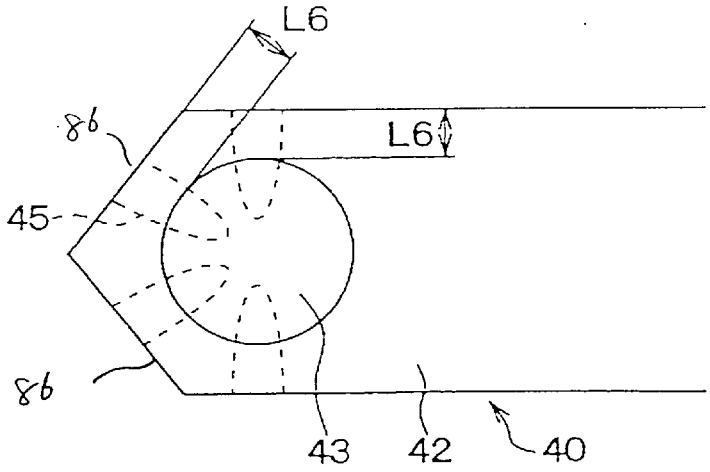
FIG. 11 is a partially plan view which shows an Ir-alloy chip and a ground electrode of a spark plug according to the fourth embodiment of the invention.

FIG. 11 shows the fourth embodiment of the invention which is different from the one shown in FIG. 10 in that two tapered surfaces 86 are formed on the tip of the ground electrode 40 which traverse each other to define a sharp tip and which have the fused portions 45 formed therein. It is advisable that the distances $L_6$ between the outer side wall of the Ir-alloy chip 43 and portions of the outer side wall of the ground electrode 40 in which the fused portions 45 are to be formed be equal to each other for facilitating ease of the welding operation to join the Ir-alloy chip 43 to the ground electrode 40. Other arrangements are identical with those in the third embodiment, and explanation thereof in detail will be omitted here.

Figure 12:
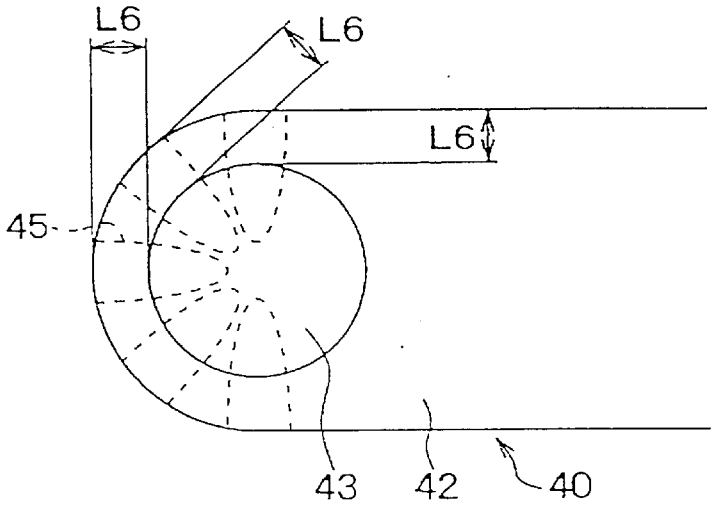
FIG. 12 is a partially plan view which shows an Ir-alloy chip and a ground electrode of a spark plug according to the fifth embodiment of the invention.

FIG. 12 shows the fifth embodiment of the invention which is different from the ones shown in FIGS. 10 and 11 in that the ground electrode 40 has a round tip in which the fused portions 45 are formed at constant angular intervals. It is advisable that the distance $L_6$ between the outer side wall of the Ir-alloy chip 43 and the outer side wall of the round tip of the ground electrode 40 be constant for facilitating ease of the welding operation to join the Ir-alloy chip 43 to the ground electrode 40. Other arrangements are identical with those in the third and fourth embodiments, and explanation thereof in detail will be omitted here.

Figure 13A:
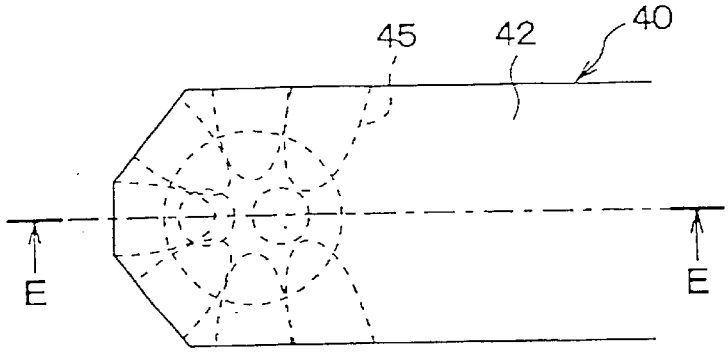
FIG. 13(*a*) is a partially plan view which shows an Ir-alloy chip and a ground electrode of a spark plug according to the sixth embodiment of the invention.
Figure 13B:
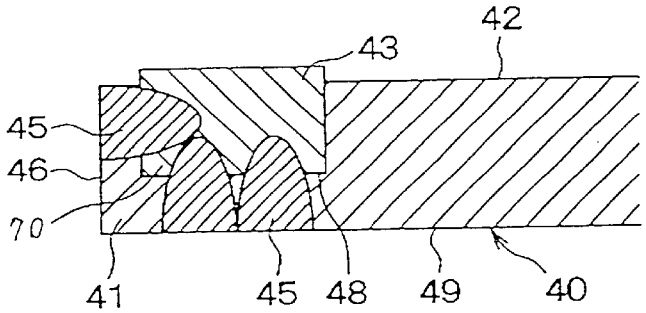

FIGS. 13(*a*) and 13(*b*) show the sixth embodiment of the invention which is a modification of the one shown in FIG. 10.

Seven fused portions 45 are formed in the outer side wall of the ground electrode 40, while two fused portions 45 are also formed in the bottom 49 of the ground electrode 40 (i.e., the surface of the ground electrode 40 opposite the center electrode 30) and extend inside the Ir-alloy chip 43.

Figure 14:
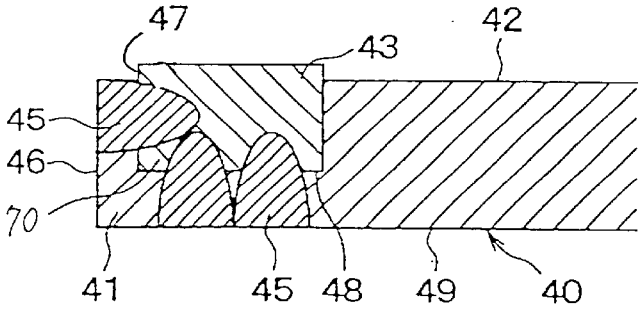
FIG. 14 is a partially vertical sectional view which shows an Ir-alloy chip and a ground electrode of a spark plug according to the seventh embodiment of the invention.

FIG. 14 shows the seventh embodiment of the invention which is different from the above embodiments only in that a single fused portion 45 is formed in the outer side wall 46 of the ground electrode 40 to define a wider bottom wall 70 which establishes tight engagement with the inner wall of the recess 44. This structure also provides substantially the same effects as those in the above embodiments.

Figure 15:
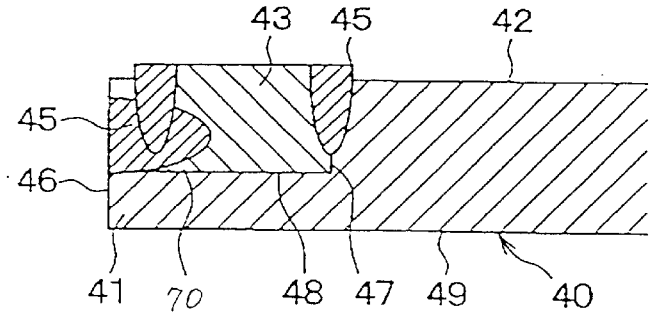
FIG. 15 is a partially vertical sectional view which shows an Ir-alloy chip and a ground electrode of a spark plug according to the eighth embodiment of the invention.

FIG. 15 shows the eighth embodiment of the invention.

The joining of the Ir-alloy chip 43 to the ground electrode 4 is achieved by at least one fused portion 45 extending from the outer side wall 46 of the ground electrode 40 inside the Ir-alloy chip 43 and a plurality of fused portions 45 extending downward, as viewed in the drawing, from the surface of the ground electrode 40 exposed outside the spark discharging surface 42 of the ground electrode 40. The vertical fused portions 45 extend through the outer side wall 47 of the Ir-alloy chip 43, that is, they extend through an interface between the outer side wall 47 of the Ir-alloy chip 43 and the inner wall of the recess 44.

Figure 16:
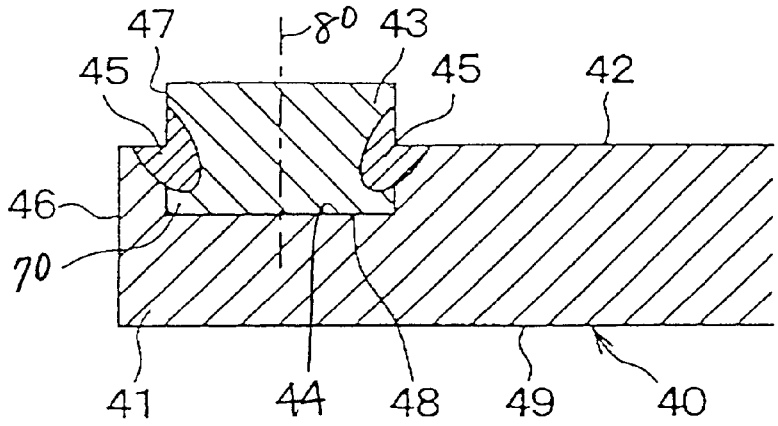
FIG. 16 is a partially vertical sectional view which shows an Ir-alloy chip and a ground electrode of a spark plug according to the ninth embodiment of the invention.

FIG. 16 shows the ninth embodiment of the invention.

A plurality of fused portions 45 are formed in a corner defined between the outer side wall of the Ir-alloy chip 47 and the spark discharging surface 42. Specifically, the fused portions 45 extend from the outer side wall 47 of the Ir-alloy chip 43 and the spark discharging surface 42 of the ground electrode 40 diagonally toward the vertical center line 80 of the Ir-alloy chip 43 so as to define the bottom wall 70 of a given thickness beneath the fused portions 45 which establishes tight engagement with the inner wall of the recess 44.

Figure 17:
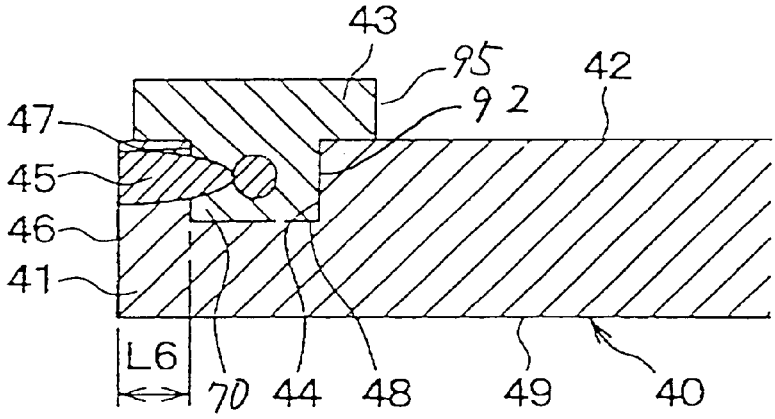
FIG. 17 is a partially vertical sectional view which shows an Ir-alloy chip and a ground electrode of a spark plug according to the tenth embodiment of the invention.

FIG. 17 shows the tenth embodiment of the invention.

The Ir-alloy chip 43 is made of a cylindrical member consisting of a small-diameter portion 92 and a large-diameter portion 95. The small-diameter portion 92 is fitted within the recess 44 of the ground electrode 40, while the large-diameter portion is placed on the spark discharging surface 42 of the ground electrode 40. The fused portions 45 are formed around the outer side wall 47 of the small-diameter portion 92. This structure provides a relatively wider spark-discharging surface to the Ir-alloy chip 43 without sacrificing the distances $L_6$ between the outer side wall 47 of the small-diameter portion 92 of the Ir-alloy chip 43 and portions of the outer side wall 46 of the ground electrode 40 in which the fused portions 45 are to be formed.

Figure 18B:
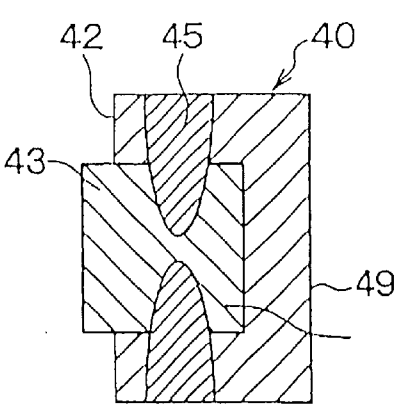
FIG. 18(*a*) is a partially horizontal sectional view which shows an Ir-alloy chip and a ground electrode of a spark plug according to the eleventh embodiment of the invention.
Figure 18A:
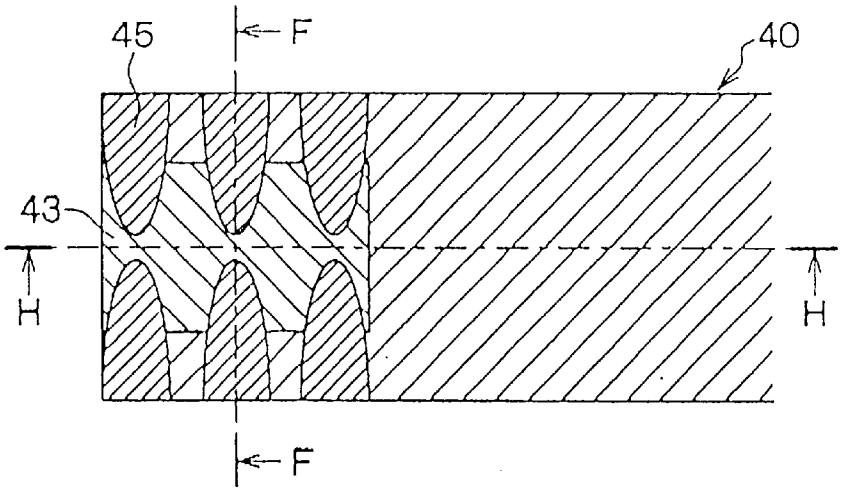
Figure 18C:
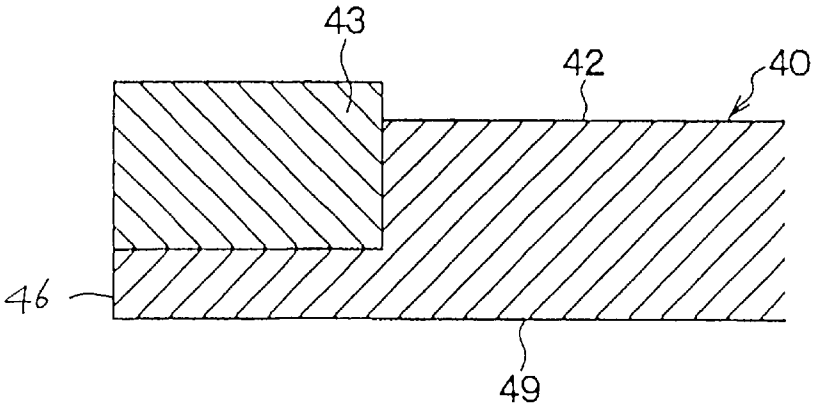

FIGS. 18(*a*), 18(*b*), and 18(*c*) show the eleventh embodiment of the invention. FIG. 18(*a*) is a sectional view which illustrates the Ir-alloy chip 43 embedded in the ground electrode 40 as viewed from the center electrode 30. FIG. 18(*b*) is a sectional view taken along the line F-Fin FIG. 18(*a*). FIG. 18(*c*) is a sectional view taken along the line H—H in FIG. 18(*a*).

The Ir-alloy chip 43 is made of a square block (i.e., a prism) and has a side surface exposed, as clearly shown in FIG. 18(*c*), outside the end 46 of the ground electrode 40. Three fused portions 45 are formed in each side wall of the ground electrode 40. Other arrangements are identical with those in the above embodiments, and explanation thereof in detail will be omitted here.

Figure 19:
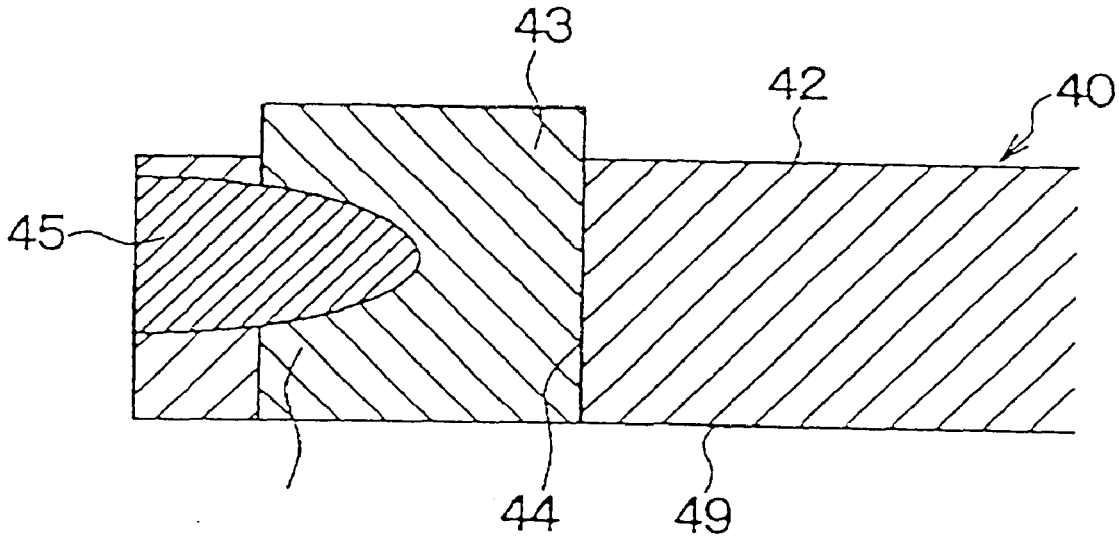
FIG. 19 is a partially vertical view which shows an Ir-alloy chip and a ground electrode of a spark plug according to the twelfth embodiment of the invention.

FIG. 19 shows the twelfth embodiment of the invention.

The ground electrode 40 has a chamber 44 formed in an end portion thereof which opens into the spark discharging surface 42 and the bottom 49. The Ir-alloy chip 43 is fitted within the opening 44. This structure provides for ease of machining of the chamber 44.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims. For example, the joining of Ir-alloy chip 43 to the ground electrode 40 may be achieved with resistance welding or plasma arc welding. The invention may also be used with a spark plugs of the type, as taught in U.S. Pat. No. 6,225,752, in which a sequence of sparks are produced between a side peripheral wall of a center electrode and an end of a ground electrode. In this case, the Ir-alloy chip 43 is installed in the end of the ground electrode. The Ir-alloy chips 31*a* and 43 are each made from material containing 90 Wt % of Ir, but may be made from material containing 70 to 99 Wt % of Ir.

What is claimed is:

1. A spark plug comprising:

a metal shell;

a center electrode retained within said metal shell to be insulated from said metal shell;

a ground electrode joined to said metal shell, said ground electrode having a center electrode-facing surface opposed to a tip of said center electrode through a spark plug gap, said ground electrode having a recess formed in the center electrode-facing surface; and an Ir-alloy chip working to produce a spark between itself and the tip of said center electrode, said Ir-alloy chip being embedded in the center electrode-facing surface of said ground electrode with a portion thereof exposed outside the center electrode-facing surface of said ground electrode, wherein said Ir-alloy chip other than the exposed portion thereof is installed inside said ground electrode, and said Ir-alloy chip is joined to said ground electrode through at least one fuse portion in which materials of said Ir-alloy chip and said ground electrode are melted together, said Ir-alloy chip being fitted within said recess, said fused portion extending continuously from an outer side wall of said ground electrode inside said Ir-alloy chip through an outer side wall of said Ir-alloy chip, the outer side wall of the ground electrode being defined between the center electrode-facing surface of the ground electrode and a surface of the ground electrode opposite the center electrode-facing surface.

2. A spark plug as set forth in claim 1, wherein said Ir-alloy chip has at least one surface which lies flush with a side surface of said ground electrode continuing from a peripheral edge of the center electrode-facing surface.

3. A spark plug as set forth in claim 1, wherein the exposed portion of said Ir-alloy chip projects from the center electrode-facing surface of said ground electrode toward said center electrode.

4. A spark plug as set forth in claim 3, wherein a distance between an end of the exposed portion of said Ir-alloy chip oriented toward said center electrode and the center electrode-facing surface of said ground electrode lies within a range of 0.1 mm to 1.0 mm.

5. A spark plug as set forth in claim 1, wherein the fused portion is formed by laser welding.

6. A spark plug as set forth in claim 1, wherein the shortest distance between the fused portion and said center electrode is more than or equal to the sum of an interval between the tip of said center electrode and said Ir-alloy chip through an outer side wall of said Ir-alloy chip.

7. A spark plug as set forth in claim 1, wherein said ground electrode has a second surface opposed to the center electrode-facing surface, a tip of the fused portion lies within said Ir-alloy chip closer to the center electrode-facing surface than the second surface, and a distance between a tip of the fused portion and a bottom of said Ir-alloy chip lying inside said ground electrode is greater than or equal to 0.1 mm.

8. A spark plug as set forth in claim 1, wherein a length of a part of the fused portion lying within said Ir-alloy chip is greater than or equal to 0.2 mm.

9. A spark plug as set forth in claim 1, wherein a distance between a tip of the fused portion and the center electrode-facing surface of said ground electrode is greater than or equal to 0.2 mm.

10. A spark plug as set forth in claim 1, wherein a distance between the outer side wall of said Ir-alloy chip and the outer side wall of said ground electrode is greater than or equal to 0.25 mm.

11. A spark plug as set forth in claim 1, wherein the fused portion lies close to a joint of said ground electrode and said metal shell from a center line of said Ir-alloy chip extending toward said center electrode through the spark plug gap.

12. A spark plug as set forth in claim 1, wherein said Ir-alloy chip is made from material containing a main component of Ir (Iridium) and an additive of at least one of Rh (rhodium), Pt (platinum), Ru (ruthenium), Pd (palladium), and W (tungsten).

13. A spark plug as set forth in claim 12, wherein said Ir-alloy chip contains 70 to 99 Wt % of Ir.

14. A spark plug as set forth in claim 1, wherein said Ir-alloy chip is joined to said ground electrode through a plurality of fused portions in which materials of said Ir-alloy chip and said ground electrode are melted together, and wherein at least one of the fused portion lies close to a joint of said ground electrode and said metal shell from a center line of said Ir-alloy chip extending toward said center electrode through the spark plug gap.

* * * * *